US009450357B2

(12) United States Patent
Kim et al.

(10) Patent No.: US 9,450,357 B2
(45) Date of Patent: Sep. 20, 2016

(54) MODULE TYPE POWER DISTRIBUTION UNIT HAVING A MULTI SOCKET MODULE FOR SELECTIVELY SUPPLYING DIFFERENT KINDS OF POWER

(71) Applicant: KOREA ELECTRONICS TECHNOLOGY INSTITUTE, Seongnam-si, Gyeonggi-do (KR)

(72) Inventors: Hyun Woo Kim, Seongnam-si (KR); Young Hwan Kim, Yongin-si (KR)

(73) Assignee: KOREA ELECTRONICS TECHNOLOGY INSTITUTE, Seongnam-si, Gyeonggi-do (KR)

( * ) Notice: Subject to any disclaimer, the term of this patent is extended or adjusted under 35 U.S.C. 154(b) by 0 days.

(21) Appl. No.: 14/575,155

(22) Filed: Dec. 18, 2014

(65) Prior Publication Data

US 2015/0188269 A1 Jul. 2, 2015

(30) Foreign Application Priority Data

Dec. 31, 2013 (KR) ..... 10-2013-0168083

(51) Int. Cl.
*H01R 25/00* (2006.01)
*H01R 9/24* (2006.01)

(52) U.S. Cl.
CPC ..... *H01R 25/003* (2013.01); *H01R 9/2408* (2013.01)

(58) Field of Classification Search
CPC ..... H01R 25/00; H01R 25/003
USPC ..... 439/638
See application file for complete search history.

(56) References Cited

U.S. PATENT DOCUMENTS 5,466,974 A * 11/1995 Sutrina ..... H02B 1/04 307/38
5,579,201 A * 11/1996 Karageozian ..... G06F 1/266 307/38
5,821,636 A * 10/1998 Baker ..... H02J 3/38 307/64
6,445,087 B1 * 9/2002 Wang ..... H01R 25/003 307/139
7,208,850 B2 * 4/2007 Turner ..... H01R 25/003 307/23
7,338,331 B2 * 3/2008 Yoon ..... H01R 9/2475 439/709
7,897,886 B1 * 3/2011 Czarnecki ..... H01H 1/38 200/50.28
8,094,436 B2 * 1/2012 Mills ..... H02B 1/056 361/634
8,174,149 B2 * 5/2012 Chapel ..... H01R 13/6683 307/64
8,355,832 B2 * 1/2013 Rosendahl ..... B60L 1/04 307/10.1
2004/0169420 A1 * 9/2004 Rendic ..... G06F 1/266 307/38
2008/0013909 A1 * 1/2008 Kostet ..... G02B 6/3851 385/135
2013/0196535 A1 * 8/2013 Utz ..... H01R 23/6866 439/536

FOREIGN PATENT DOCUMENTS

JP 2011044344 A 3/2011

OTHER PUBLICATIONS

Office Action for corresponding Korean Application No. 10-2013-0168083 received Mar. 23, 2015.

* cited by examiner

*Primary Examiner* — Chandrika Prasad
(74) *Attorney, Agent, or Firm* — Hauptman Ham, LLP

(57) ABSTRACT

A module type PDU for different power supply is provided. The PDU includes: a base configured to transmit different kinds of power; and a multi socket module connected with the base to transmit one kind of power to devices plugs of which are connected to the multi socket module. Accordingly, double power supply can be achieved through a single PDU and thus a PDU installing cost can be reduced, and, as the number of PDUs is reduced, electric equipments can be simplified.

9 Claims, 7 Drawing Sheets

MODULE TYPE POWER DISTRIBUTION UNIT HAVING A MULTI SOCKET MODULE FOR SELECTIVELY SUPPLYING DIFFERENT KINDS OF POWER

CROSS-REFERENCE TO RELATED APPLICATION(S) AND CLAIM OF PRIORITY

The present application claims the benefit under 35 U.S.C. §119(a) to a Korean patent application filed in the Korean Intellectual Property Office on Dec. 31, 2013, and assigned Serial No. 10-2013-0168083, the entire disclosure of which is hereby incorporated by reference.

TECHNICAL FIELD OF THE INVENTION

The present invention relates generally to a Power Distribution Unit (PDU), and more particularly, to a PDU which transmits power to servers in a data center environment.

BACKGROUND OF THE INVENTION

Various methods for using a high performance server uninterruptedly in an environment where a plurality of servers are used like a data center are developing. One of them is to double supply power to a server. This method supplies separate power and prevents abnormal power supply even when a problem arises from one power supply system.

However, in order to double supply power, a PDU should be connected to different power sources and thus two PDUs are physically required. Accordingly, a double power system is required and thus an operator should add the same PDU set as the existing PDU set.

SUMMARY OF THE INVENTION

To address the above-discussed deficiencies of the prior art, it is a primary aspect of the present invention to provide a module type PDU which can transmit different kinds of power through a single unit, thereby achieving double power supply and making it easy to extend/separate.

According to one aspect of the present invention, a PDU includes: a base configured to transmit different kinds of power; and a multi socket module connected with the base to transmit one kind of power to devices plugs of which are connected to the multi socket module.

When the multi socket module is connected with the base in a first direction, the multi socket module may transmit first power to the devices, and, when the multi socket module is connected with the base in a second direction, the multi socket module may transmit second power to the devices.

The first power may be normal power, and the second power may be emergency power.

The base may include: a first output terminal configured to output the first power to the multi socket module; and a second output terminal configured to output the second power to the multi socket module, and a display for indicating a kind of the first power may be displayed around the first output terminal, and a display for indicating a kind of the second power may be displayed around the second output terminal.

A plurality of multi socket modules may be connectable with the base.

Multi socket modules having sockets of different standards may be connectable with the base.

As described above, according to exemplary embodiments of the present invention, double power supply can be achieved through a single PDU. That is, normal power and emergency power can be transmitted through a single PDU. Accordingly, a PDU installing cost can be reduced, and, as the number of PDUs is reduced, electric equipments can be simplified.

In addition, according to exemplary embodiments of the present invention, multi sockets of a PDU can be implemented in the form of a module and thus it is easy to extend and change the PDU. In addition, sockets of various standards can be used and thus the PDU can be widely utilized.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

Figure 1:
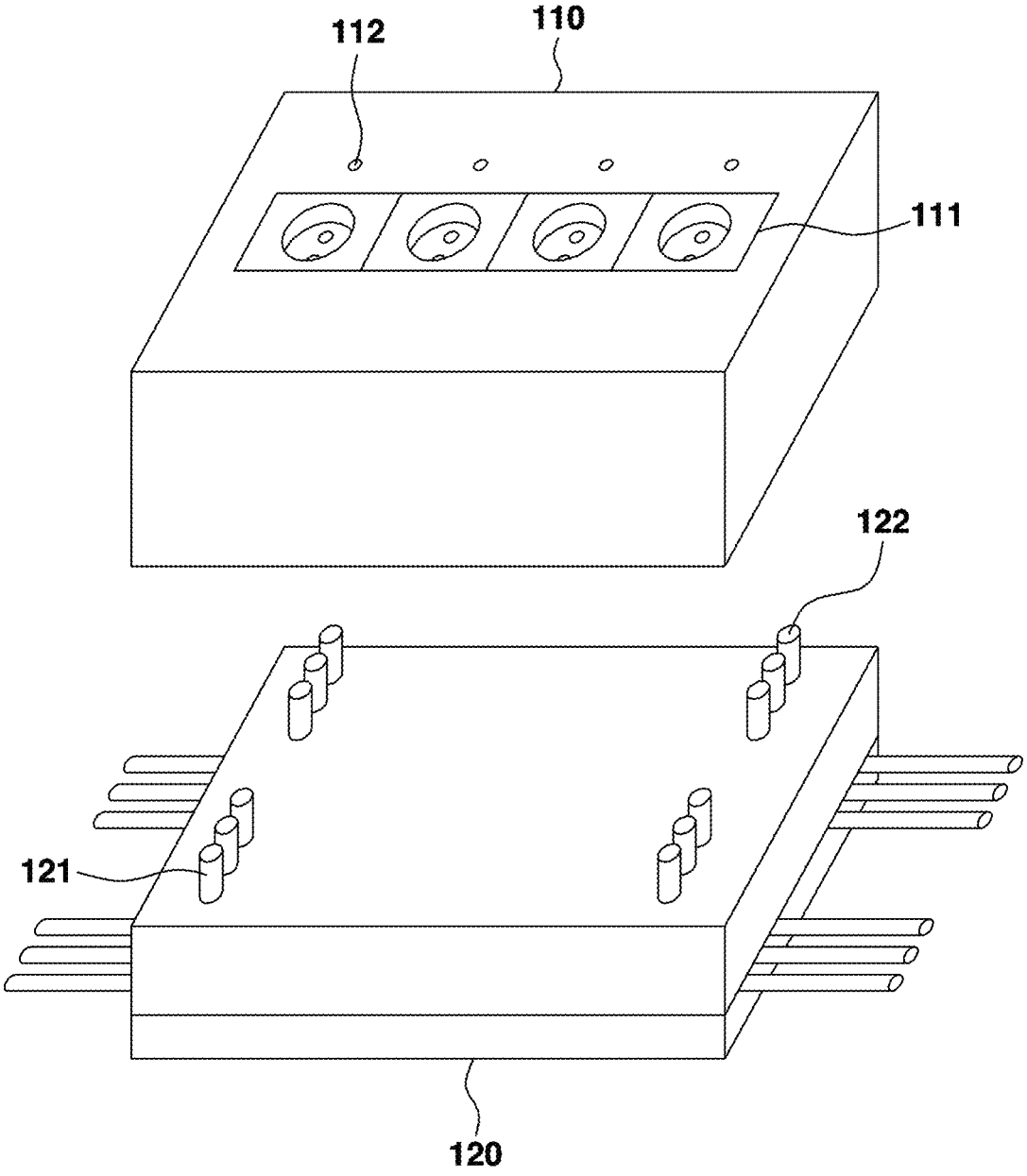
FIG. 1 is a view to explain the concept of a PDU according to an exemplary embodiment of the present invention.

Reference will now be made in detail to the embodiment of the present general inventive concept, examples of which are illustrated in the accompanying drawings, wherein like reference numerals refer to the like elements throughout. The embodiment is described below in order to explain the present general inventive concept by referring to the drawings.

Figure 7:
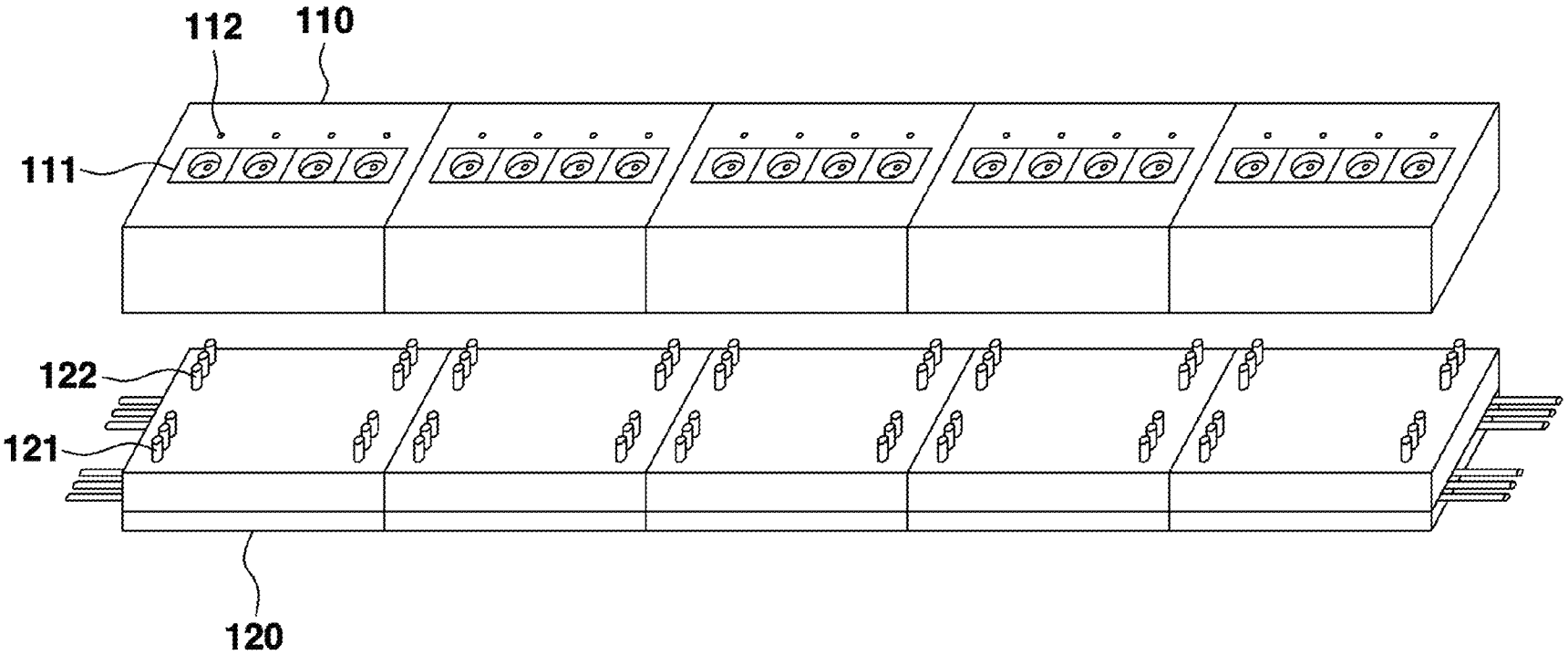
FIG. 7 is a view showing a PDU according to an exemplary embodiment of the present invention.

FIG. 1 is a view to explain the concept of a PDU according to an exemplary embodiment of the present invention. The whole PDU is illustrated in FIG. 7. FIG. 1 illustrates only a part of the PDU to explain the concept of the PDU according to an exemplary embodiment of the present invention.

The PDU according to an exemplary embodiment of the present invention may be used to supply power to a plurality of server racks in an Internet Data Center (IDC). However, this is merely an example and the PDU may be used for other purposes.

The PDU which performs the above-described function includes a multi socket module 110 and a base 120 as shown in FIG. 1.

The base 120 is a means for receiving power from an external source and transmitting the power to the multi socket module 110, and receives/transmits normal power and emergency power. The normal power is supplied by Korea Electric Power Corporation and is output through a normal power output terminal 121. The emergency power is supplied by Uninterruptible Power Supply (UPS) installed in the IDC and is output through an emergency power output terminal 122.

That is, the PDU according to the exemplary embodiment of the present invention supplies different kinds of power including the normal power and the emergency power for the sake of electrical redundancy.

The multi socket module 110 includes multi sockets 111 and state display lamps 112. Plugs of servers are connected to the multi sockets 111 and the state display lamp 112 is lit when a corresponding socket is able to transmit power.

The multi socket module 110 is connected with the base 120 to output power output from the base 120 through the multi sockets 111 and thus transmit the power to the servers the plugs of which are connected to the multi sockets 111.

The kind of the power received by the multi socket module 110 from the base 120 is determined based on a connection direction of the multi socket module 110 and the base 120.

Figure 2:
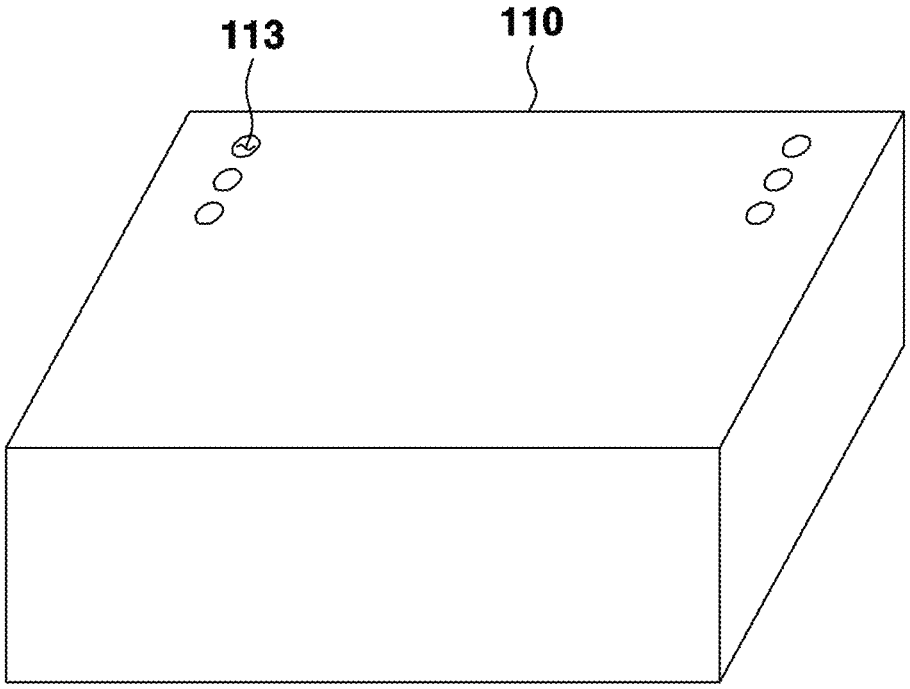
FIG. 2 is a view showing a multi socket module, rotated 180° about a lengthwise direction axis of multi sockets from the view of FIG. 1.

Specifically, a single power input terminal 113 is provided on a bottom surface of the multi socket module 110 as shown in FIG. 2. FIG. 2 is a view showing the multi socket module 110, rotated 180° about the lengthwise direction axis of the multi sockets 111 from the view of FIG. 1.

Accordingly, when the power input terminal 113 is connected with the normal power output terminal 121 of the base 120, the multi sockets 111 output the normal power, and, when the power input terminal 113 is connected with the emergency power output terminal 122 of the base 120, the multi sockets 111 output the emergency power.

Figure 3:
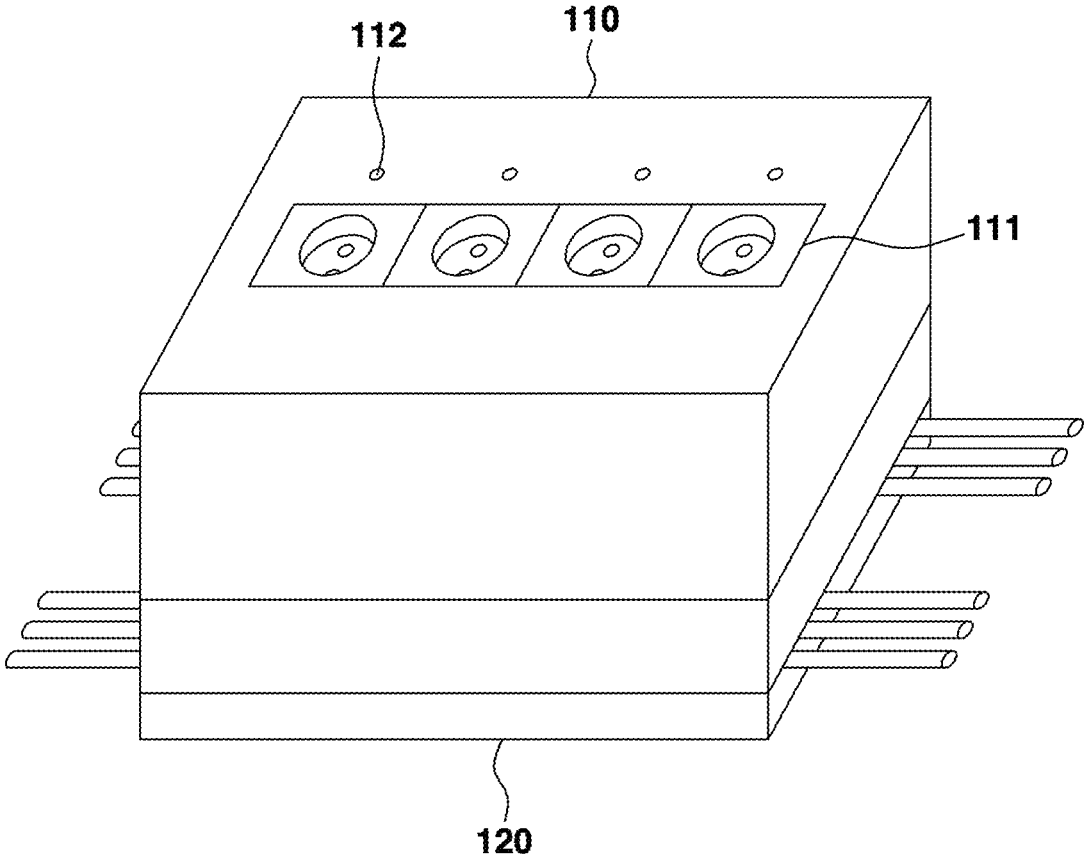
FIG. 3 is a view showing the multi socket module which is connected with a base to transmit normal power.

FIG. 3 illustrates the multi socket module 110 which is connected with the base 120 to transmit the normal power.

Figure 4:
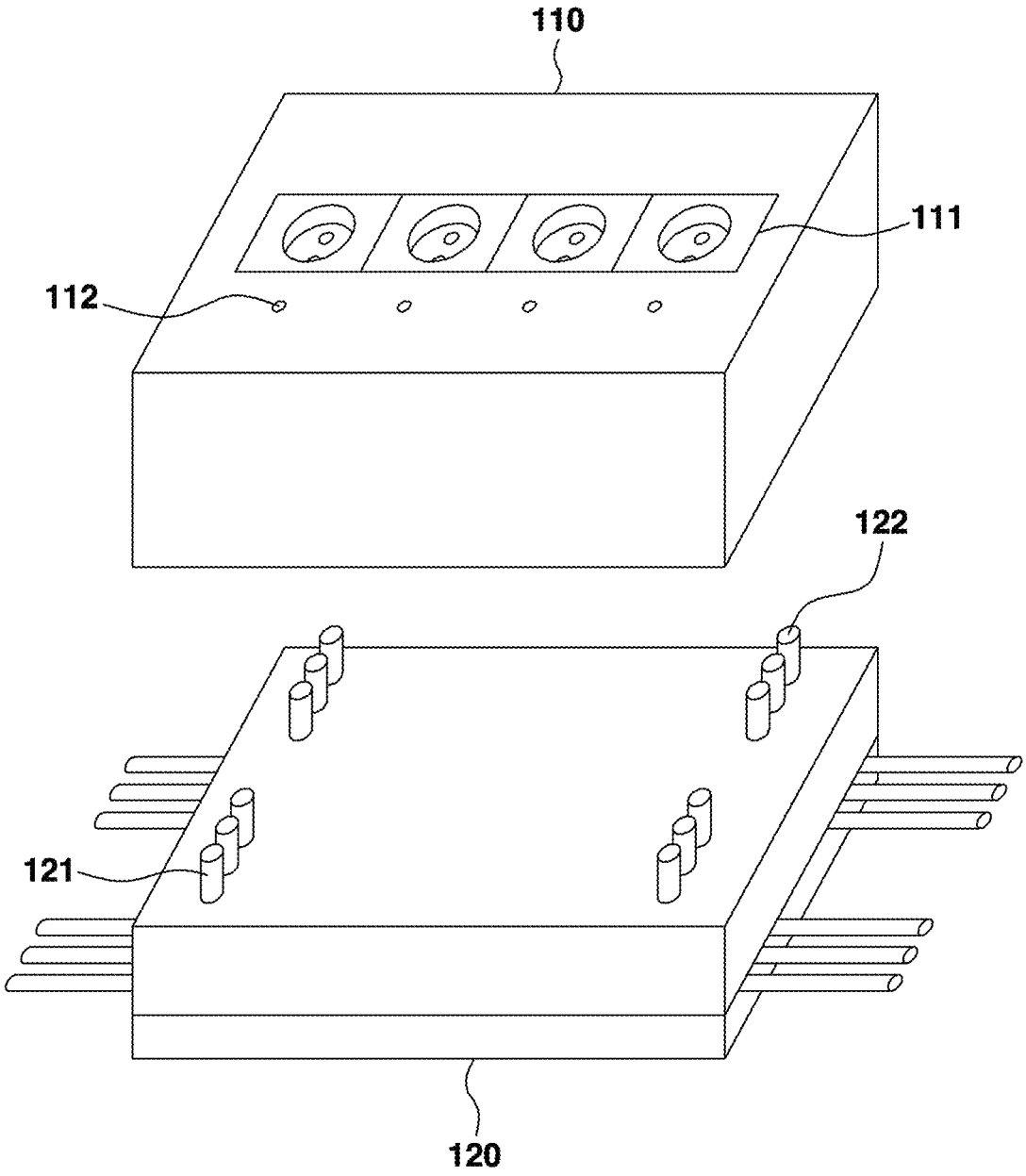
FIG. 4 is a view showing the multi socket module in a state where it is connectible with an emergency power output terminal of the base.

In FIG. 4, the multi socket module 110 is in a state where it is able to be connected with the emergency power output terminal 122 of the base 120. It can be seen that the locations of the multi socket module 110 and the state display lamps 112 are opposite to those of FIG. 1

Figure 5:
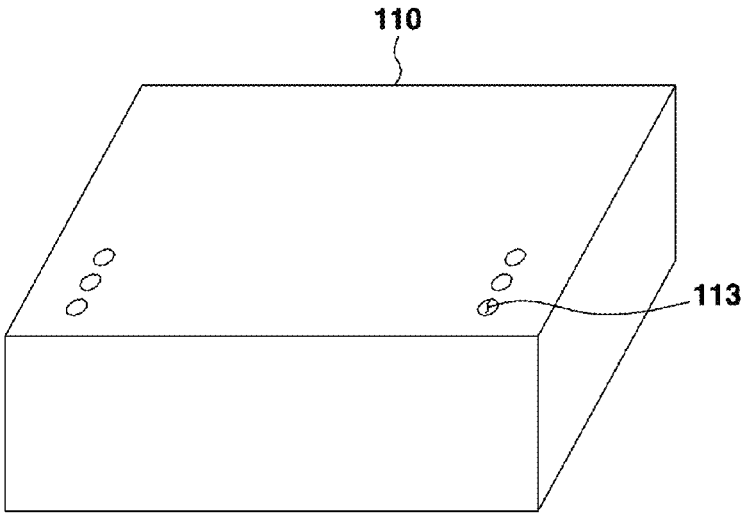
FIG. 5 is a view showing the multi socket module, rotated 180° about the lengthwise direction axis of the multi sockets from the view of FIG. 4.

In addition, FIG. 5 is a view showing the multi socket module 110, rotated 180° about the lengthwise direction axis of the multi sockets 111 from the view of FIG. 4. It can be seen that the locations of the multi socket module 110 and the power input terminal 113 are opposite to those of FIG. 2.

Figure 6:
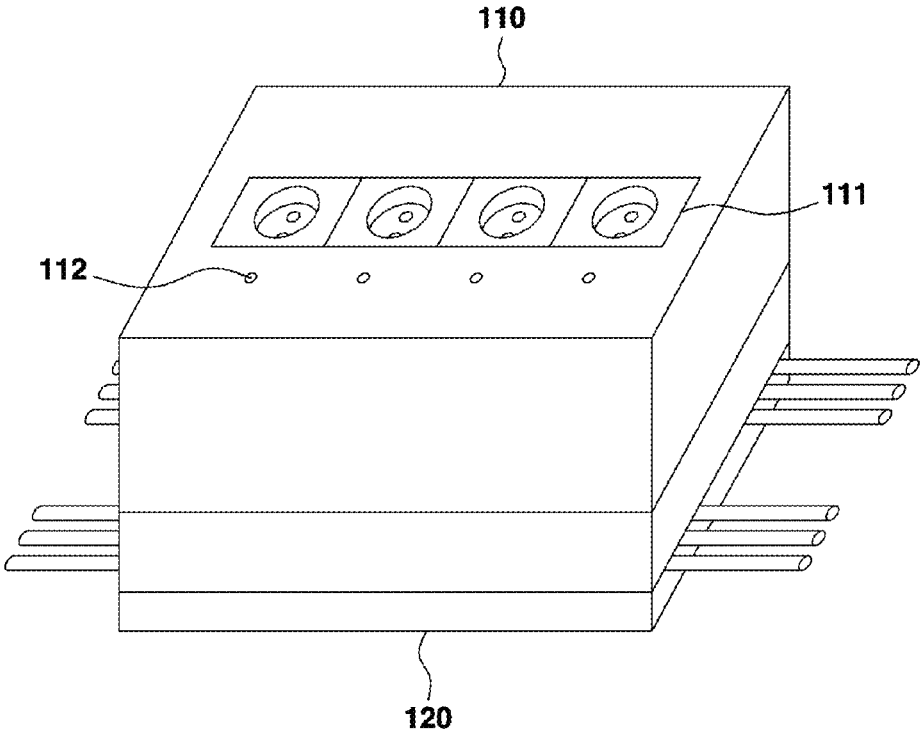
FIG. 6 is a view showing the multi socket module which is connected with the base to transmit emergency power.

FIG. 6 illustrates the multi socket module 110 which is connected with the base 120 to transmit the emergency power. Likewise, it can be seen that the locations of the multi socket module 110 and the state display lamps 112 are opposite to those of FIG. 3.

A text, a mark, or other indicators may be displayed on a side surface of the base 120 or around the output terminals 121 and 122 to inform the kind of power (normal power or emergency power) output through the output terminals 121 and 122.

FIG. 7 is a view showing a PDU according to an exemplary embodiment of the present invention. As shown in FIG. 7, the base 120 of the PDU according to an exemplary embodiment of the present invention may be designed to connect with five (5) multi socket modules 110. However, "five" is merely an exemplary number. That is, the base 120 may be designed to connect with more than 5 or less than 5 multi socket modules 110.

All of the connectible multi socket modules 110 are not connected with the base 120. A smaller number of multi socket modules 110 may be connected. For example, the number of multi socket modules 110 connectible with the base 120 is five (5), but four (4) multi socket modules 110 may be connected.

Furthermore, the base 120 may be implemented in the form of a module and the number of connectible multi socket modules 110 may be determined according to the number of modules assembled.

Figure 8:
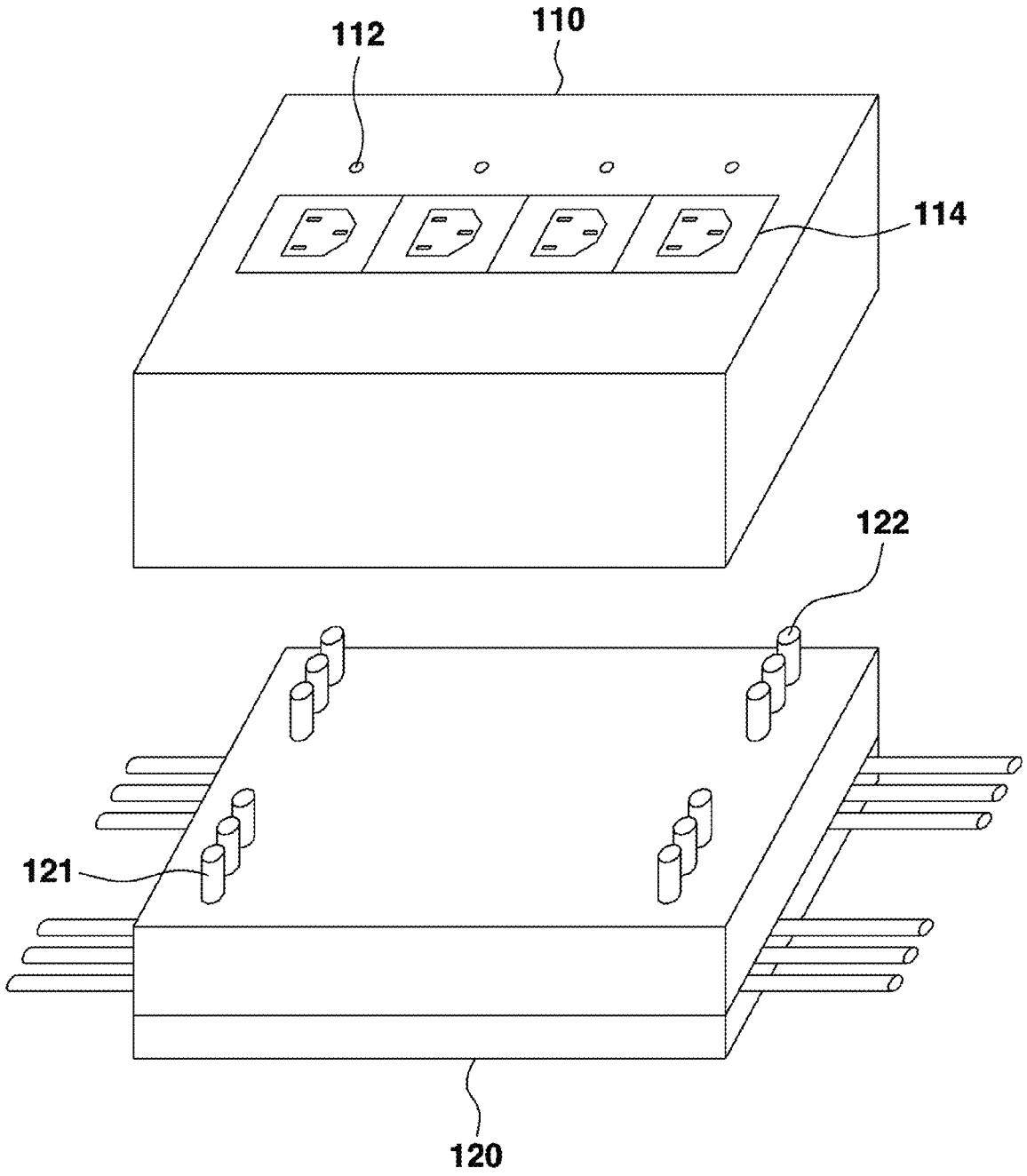
FIG. 8 is a view showing a multi socket module on which multi sockets of a different standard are provided.

In addition, multi sockets having a different standard from that of the multi sockets 111 may be provided on the multi socket module 110. For example, as shown in FIG. 8, the multi socket module 110 having multi sockets 114 of a different standard from that of the multi sockets 111 may be connected with the base 120.

Furthermore, the standards of the multi sockets implemented in the multi socket modules 110 connected with the base 120 may differ from multi socket module to multi socket module.

That is, the PDU according to the exemplary embodiment of the present invention can be customized to a server environment of the IDC and thus can be changed or extended freely later.

The exemplary embodiment of the module type PDU which can supply different kinds of power has been described up to now.

In the above-described exemplary embodiment, the PDU supplies two kinds of power selectively. However, this is merely an example. The technical idea of the present invention can be applied when three or more kinds of power are selectively supplied.

Furthermore, the standard of the socket described above is merely an example. The technical idea of the present invention can be applied to sockets of other standards.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A Power Distribution Unit (PDU), comprising:

a base configured to receive a first power and a second power, wherein the base comprises a first power output terminal and a second power output terminal, and the base is configured to transmit the received first power to the first power output terminal and the received second power to the second power output terminal; and a multi socket module comprising a power input terminal and a plurality of power output sockets connected to the power input terminal, wherein, when the multi socket module is connected with the base in a first direction of the multi socket module on the base, the multi socket module is configured to transmit, to the plurality of power output sockets, the first power from a connection between the power input terminal and the first power output terminal of the base, and when the multi socket module is connected with the base in a second direction opposite to the first direction of the multi socket module, the multi socket module is configured to transmit, to the plurality of power output sockets, the second power from a connection between the power input terminal and the second power output terminal of the base.

2. The PDU of claim 1, wherein the first power is normal power, and the second power is emergency power.

3. The PDU of claim 1, further comprising a further multi socket module identical to the multi socket module, wherein the multi socket module and the further multi socket module are connected with the base in a same direction.

4. The PDU of claim 1, wherein the plurality of power output sockets of the multi socket module include power output sockets of at least two different standards.

5. A Power Distribution Unit (PDU), comprising:

a base comprising a first power output terminal placed on a first half area of an upper surface of the base and a second power output terminal placed on a second half area of the upper surface of the base, the base configured to receive a first power and a second power, and transmit the received first power to the first power output terminal and the received second power to the second power output terminal; and a multi socket module comprising a power input terminal placed on a bottom surface of the multi socket module, and a plurality of power output sockets connected to the power input terminal and placed on an upper surface of the multi socket module, wherein, when the multi socket module is connected with the base in a first direction of the multi socket module, the multi socket module is configured to transmit, to the plurality of power output sockets, the first power via a connection between the power input terminal and the first power output terminal, and when the multi socket module is connected with the base in a second direction opposite to the first direction of the multi socket module, the multi socket module is configured to transmit, to the plurality of power output sockets, the second power via a connection between the power input terminal and the second power output terminal.

6. The PDU of claim 5, wherein the first power is normal power, and the second power is emergency power.

7. The PDU of claim 5, further comprising a further multi socket module identical to the multi socket module.

8. The PDU of claim 7, wherein the multi socket module and the further multi socket module are connected with the base in a same direction.

9. The PDU of claim 5, wherein the plurality of power output sockets of the multi socket module include power output sockets of at least two different standards.

* * * * *